US006812648B2

(12) United States Patent
Luten et al.

(10) Patent No.: US 6,812,648 B2
(45) Date of Patent: Nov. 2, 2004

(54) METHOD OF CLEANING ION SOURCE, AND CORRESPONDING APPARATUS/ SYSTEM

(75) Inventors: Henry A. Luten, Ypsilanti, MI (US); Vijayen S. Veerasamy, Ann Arbor, MI (US); Maximo Frati, Fort Collins, CO (US); Denis Shaw, Fort Collins, CO (US)

(73) Assignees: Guardian Industries Corp., Auburn Hills, MI (US); Advanced Energy Industries, Inc., Fort Collins, CO (US)

( * ) Notice: Subject to any disclaimer, the term of this patent is extended or adjusted under 35 U.S.C. 154(b) by 0 days.

(21) Appl. No.: 10/419,990

(22) Filed: Apr. 22, 2003

(65) Prior Publication Data

US 2004/0075060 A1 Apr. 22, 2004

Related U.S. Application Data

(60) Provisional application No. 60/419,519, filed on Oct. 21, 2002.

(51) Int. Cl.[7] ..... H01J 49/10

(52) U.S. Cl. ..... 315/111.81; 250/423 R; 250/431

(58) Field of Search ..... 250/423 R; 315/111.81, 315/111.21, 111.91; 204/192 R

(56) References Cited

U.S. PATENT DOCUMENTS

| | | | | |
|---|---|---|---|---|
| 2,672,560 | A | | 3/1954 | Berry |
| 3,984,692 | A | | 10/1976 | Arsenault |
| 4,122,347 | A | * | 10/1978 | Kovalsky et al. ..... 250/423 R |
| 4,303,865 | A | | 12/1981 | Swingler |
| 4,344,019 | A | * | 8/1982 | Gavin et al. ..... 315/111.81 |
| 4,361,472 | A | * | 11/1982 | Morrison, Jr. ..... 204/192.12 |
| 4,401,539 | A | | 8/1983 | Abe et al. |
| 4,434,038 | A | * | 2/1984 | Morrison, Jr. ..... 204/192.15 |
| 4,569,746 | A | | 2/1986 | Hutchinson |
| 4,572,776 | A | | 2/1986 | Aichert et al. |
| 4,595,482 | A | | 6/1986 | Mintz |
| 4,606,806 | A | | 8/1986 | Helmer |
| 4,652,795 | A | | 3/1987 | Lee et al. |
| 4,657,654 | A | | 4/1987 | Mintz |
| 4,661,228 | A | | 4/1987 | Mintz |
| 4,677,904 | A | | 7/1987 | Natsumeda et al. |
| 4,710,283 | A | | 12/1987 | Singh et al. |
| 4,865,710 | A | | 9/1989 | Aaron et al. |
| 4,865,712 | A | | 9/1989 | Mintz |
| 4,957,605 | A | | 9/1990 | Hurwitt et al. |
| 5,106,470 | A | | 4/1992 | Takei et al. |
| 5,130,607 | A | | 7/1992 | Lama |
| 5,407,551 | A | | 4/1995 | Sieck et al. |
| 5,415,754 | A | | 5/1995 | Manley |
| 5,508,368 | A | | 4/1996 | Knapp et al. |
| 5,656,819 | A | | 8/1997 | Greenly |
| 5,736,019 | A | | 4/1998 | Bernick |
| 5,865,961 | A | | 2/1999 | Yokoyama et al. |
| 5,888,593 | A | | 3/1999 | Petrmichl et al. |
| 5,889,371 | A | | 3/1999 | Boyarsky et al. |
| 5,973,447 | A | | 10/1999 | Mahoney et al. |
| 6,002,208 | A | | 12/1999 | Maishev et al. |
| 6,037,717 | A | | 3/2000 | Maishev et al. |
| 6,147,354 | A | | 11/2000 | Maishev et al. |
| 6,153,067 | A | | 11/2000 | Maishev et al. |
| 6,238,526 | B1 | | 5/2001 | Maishev et al. |
| 6,246,059 | B1 | | 6/2001 | Maishev et al. |
| 6,261,424 | B1 | | 7/2001 | Goncharenko et al. |
| 6,359,388 | B1 | | 3/2002 | Petrmichl |
| 6,395,333 | B2 | | 5/2002 | Veerasamy |
| 6,664,739 | B1 | | 12/2003 | Kishinevsky et al. |
| 2003/0077402 | A1 | | 4/2003 | Amann et al. |

* cited by examiner

*Primary Examiner*—Nikita Wells
*Assistant Examiner*—Johnnie L. Smith, II
(74) *Attorney, Agent, or Firm*—Nixon & Vanderhye P.C.

(57) ABSTRACT

A method and/or system for cleaning an ion source is/are provided. In certain embodiments of this invention, both the anode and cathode of the ion source are negatively biased during at least part of a cleaning mode. Ions generated are directed toward the anode and/or cathode in order to remove undesirable build-ups from the same during cleaning.

18 Claims, 6 Drawing Sheets

METHOD OF CLEANING ION SOURCE, AND CORRESPONDING APPARATUS/ SYSTEM

This application claims the benefit of Provisional Application No. 60/419,519, filed Oct. 21, 2002, the entire content of which is hereby incorporated by reference in this application.

This invention relates to a method of cleaning an ion source, and/or to a corresponding apparatus/system. In certain example embodiments, both the anode and cathode of the ion source are negatively biased during at least part of a cleaning mode in order to clean the ion source.

BACKGROUND OF THE INVENTION

An ion source is a device that causes gas molecules to be ionized and then accelerates and emits the ionized gas molecules and/or atoms in a beam toward a substrate. Such an ion beam may be used for various purposes, including but not limited to cleaning a substrate, activation, polishing, etching, and/or deposition of thin film coatings/layer(s). Example ion sources are disclosed, for example, in U.S. Pat. Nos. 6,359,388; 6,037,717; 6,002,208; and 5,656,819, the disclosures of which are all hereby incorporated herein by reference.

FIGS. 1–2 illustrate a conventional ion source. In particular, FIG. 1 is a side cross-sectional view of an ion beam source with an ion beam emitting slit defined in the cathode, and FIG. 2 is a corresponding sectional plan view along section line II—II of FIG. 1. FIG. 3 is a sectional plan view similar to FIG. 2, for purposes of illustrating that the FIG. 1 ion beam source may have an oval and/or racetrack-shaped ion beam emitting slit as opposed to a circular ion beam emitting slit. Any other suitable shape may also be used.

Referring to FIGS. 1–3, the ion source includes a hollow housing made of a magnetoconductive material such as steel, which is used as a cathode 5. Cathode 5 includes cylindrical or oval side wall 7, a closed or partially closed bottom wall 9, and an approximately flat top wall 11 in which a circular or oval ion emitting slit and/or aperture 15 is defined. The bottom 9 and side wall(s) 7 of the cathode are optional. Ion emitting slit/aperture 15 includes an inner periphery as well as an outer periphery.

Deposit and/or maintenance gas supply aperture or hole(s) 21 is/are formed in bottom wall 9. Flat top wall 11 functions as an accelerating electrode. A magnetic system including a cylindrical permanent magnet 23 with poles N and S of opposite polarity is placed inside the housing between bottom wall 9 and top wall 11. The N-pole faces flat top wall 11, while the S-pole faces bottom wall 9. The purpose of the magnetic system with a closed magnetic circuit formed by the magnet 23 and cathode 5 is to induce a substantially transverse magnetic field (MF) in an area proximate ion emitting slit 15. The ion source may be entirely or partially within wall 50. In certain instances, wall 50 may entirely surround the source and substrate 45, while in other instances the wall 50 may only partially surround the ion source and/or substrate.

A circular or oval shaped conductive anode 25, electrically connected to the positive pole of electric power source 29, is arranged so as to at least partially surround magnet 23 and be approximately concentric therewith. Anode 25 may be fixed inside the housing by way of insulative ring 31 (e.g., of ceramic). Anode 25 defines a central opening therein in which magnet 23 is located. The negative pole of electric power source 29 is connected to cathode 5, so that the cathode is negative with respect to the anode.

Generally speaking, the anode 25 is generally biased positive by several thousand volts. Meanwhile, the cathode (the term "cathode" as used herein includes the inner and/or outer portions thereof) is generally held at, or close to, ground potential. This is the case during all aspects of source operation, including during a mode in which the source is being cleaned.

The conventional ion beam source of FIGS. 1–3 is intended for the formation of a unilaterally directed tubular ion beam, flowing in the direction toward substrate 45. Substrate 45 may or may not be biased in different instances. The ion beam emitted from the area of slit/aperture 15 is in the form of a circle in the FIG. 2 embodiment and in the form of an oval (e.g., race-track) in the FIG. 3 embodiment.

The conventional ion beam source of FIGS. 1–3 operates as follows in a depositing mode when it is desired to ion beam deposit a layer(s) on substrate 45. A vacuum chamber in which the substrate 45 and slit/aperture 15 are located is evacuated, and a depositing gas (e.g., a hydrocarbon gas such as acetylene, or the like) is fed into the interior of the source via aperture(s) 21 or in any other suitable manner. A maintenance gas (e.g., argon) may also be fed into the source in certain instances, along with the depositing gas. Power supply 29 is activated and an electric field is generated between anode 25 and cathode 5, which accelerates electrons to high energy. Anode 25 is positively biased by several thousand volts, and cathode 5 is at ground potential or proximate thereto as shown in FIG. 1. Electron collisions with the gas in or proximate aperture/slit 15 leads to ionization and a plasma is generated. "Plasma" herein means a cloud of gas including ions of a material to be accelerated toward substrate 45. The plasma expands and fills (or at least partially fills) a region including slit/aperture 15. An electric field is produced in slit 15, oriented in the direction substantially perpendicular to the transverse magnetic field, which causes the ions to propagate toward substrate 45. Electrons in the ion acceleration space in and/or proximate slit/aperture 15 are propelled by the known E x B drift in a closed loop path within the region of crossed electric and magnetic field lines proximate slit/aperture 15. These circulating electrons contribute to ionization of the gas (the term "gas" as used herein means at least one gas), so that the zone of ionizing collisions extends beyond the electrical gap between the anode and cathode and includes the region proximate slit/aperture 15 on one and/or both sides of the cathode 5.

For purposes of example, consider the situation where a silane and/or acetylene ($C_2H_2$) depositing gas is/are utilized by the ion source of FIGS. 1–3 in a depositing mode. The silane and/or acetylene depositing gas passes through the gap between anode 25 and cathode 5. Unfortunately, certain of the elements in acetylene and/or silane gas is/are insulative in nature (e.g., carbide may be an insulator in certain applications). Insulating deposits (e.g., carbide deposits, carbon deposits, and/or oxide deposits which may be insulating or semi-insulating in nature) resulting from the depositing gas can quickly build up on the respective surfaces of anode 25 and/or cathode 5 proximate the gap therebetween, and/or at other electrode locations. This can interfere with gas flow through the gap and/or aperture 15, and/or it can reduce net current thereby adversely affecting the electric field potential between the anode and cathode proximate slit/aperture 15. Such deposits resistively limit the amount of current that can flow through the source; this adversely interferes with the operability and/or efficiency of the ion source especially over significant lengths of time. This unfortunately can also result in micro-particles from the deposits making their way into a film being deposited on the substrate. In either case, operability and/or efficiency of the ion beam source is adversely affected.

These undesirable build-ups eventually have to be cleaned off the anode and/or cathode. Conventionally, cleaning has been conducted by running the source as shown in FIG. 1 while introducing oxygen gas into the source. Unfortunately, this type of ion source cleaning technique does not do an adequate job of cleaning the anode, and anode/cathode surfaces distant from the aperture 15 tend not to be cleaned very well.

In view of the above, it will be apparent to those skilled in the art that there exists a need for a more efficient technique for cleaning an ion source.

BRIEF SUMMARY OF THE INVENTION

In certain example embodiments of this invention, both the anode and cathode of the ion source are negatively biased in order to clean the same. Surprisingly, it has been found that when the anode and cathode of an ion source are both negatively biased, undesirable build-ups (e.g., carbon inclusive build-ups) on surface(s) of the anode and/or cathode are more easily and/or quickly removed during cleaning.

In certain example embodiments of this invention, oxygen inclusive gas may be provided in the ion source during cleaning mode(s). In such embodiments, generated oxygen ions are accelerated or otherwise directed toward the anode and/or cathode in order to help remove residue (e.g., carbon inclusive build-ups) from the surface(s) thereof. In certain embodiments, the removal of carbon inclusive build-ups may be accelerated by chemical oxidation of the carbon, and/or may be caused by physical ablation of the build-ups by the accelerated ions. Gas other than oxygen may be used for cleaning in other embodiments.

In certain example embodiments of this invention, there is provided a method of cleaning an ion source, the method comprising: providing the ion source which includes an anode and a cathode; and negatively biasing both the anode and cathode during at least part of a cleaning mode.

In certain other example embodiments of this invention, there is provided a method of cleaning an ion source, the method comprising: providing the ion source including an anode, a cathode, and a magnet, wherein at least one of the anode and the cathode includes an ion emitting aperture defined therein that is used for directing ions toward a substrate during a depositing mode of operation of the ion source; and during at least part of a cleaning mode, negatively biasing both the anode and the cathode of the ion source while at least one gas for ionization is present proximate the anode and/or cathode, so that the anode and/or cathode can be cleaned.

In certain other example embodiments of this invention, there is provided an ion source comprising: an anode; a cathode; wherein at least one of the anode and cathode comprises an ion emitting aperture defined therein; and means for negatively biasing the anode and cathode during at least part of a cleaning mode so that the anode and/or cathode can be cleaned during the cleaning mode. In certain example embodiments, the anode is positively biased with respect to the cathode during a depositing mode of source operation (i.e., when the ion source is being used to ion beam depositing a layer(s) on a substrate); and the anode and cathode are both negatively biased during the cleaning mode.

In certain other example embodiments of this invention, there is provided a method of cleaning an ion source, the method comprising: providing the ion source which includes an anode and a cathode, wherein at least one of the anode and cathode includes an ion emitting aperture defined therein; during a cleaning mode, biasing the anode and cathode so that the anode and/or cathode can be cleaned by sputtering undesirable build-ups off of respective surface(s) of the anode and/or cathode; and determining when to stop the sputtering in the cleaning mode based upon at least a change in sputtering voltage present during the cleaning mode due to the biasing.

DETAILED DESCRIPTION OF CERTAIN EXAMPLE EMBODIMENTS OF THE INVENTION

Figure 2:
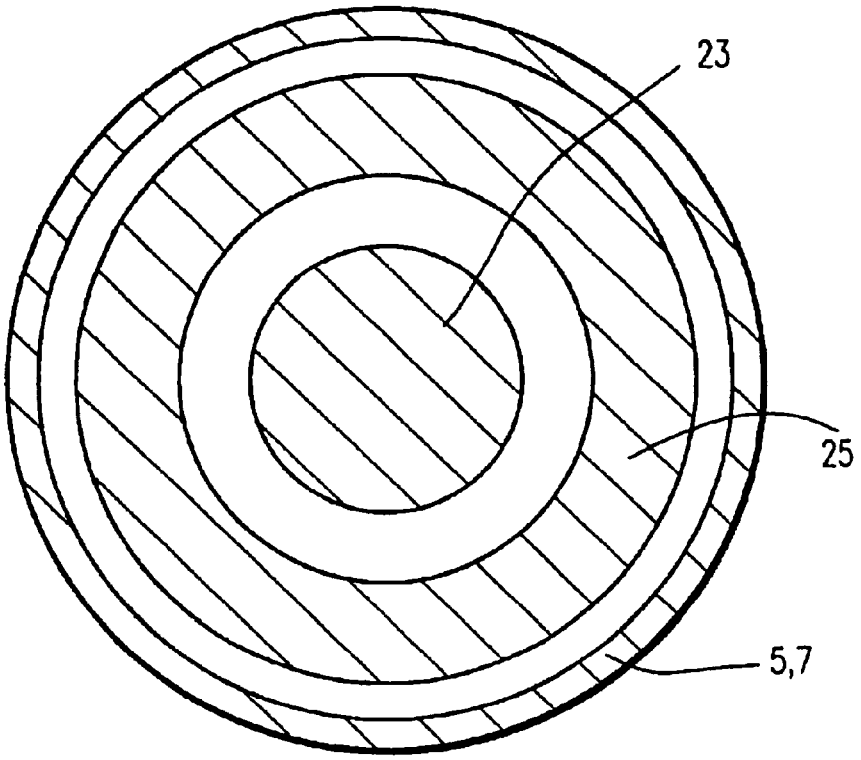
Fig. 2 (PRIOR ART)
FIG. 2 is a sectional view taken along section line II of FIG. 1.
Figure 3:
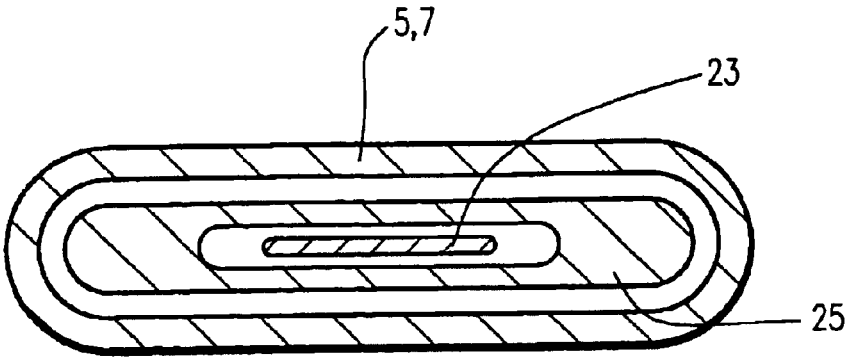
Fig. 3 (PRIOR ART)
FIG. 3 is a sectional view similar to FIG. 2, taken along section line II in FIG. 1, in another embodiment illustrating that the ion source may be shaped in an oval manner instead of in a circular manner in certain instances.

Referring now more particularly to the accompanying drawings, in which like reference numerals indicate like parts throughout the several views. Thus, reference numerals used in FIGS. 4–6 may be used for the same components discussed above with respect to FIGS. 1–3.

In the following description, for purposes of explanation and not limitation, specific details are set forth in order to provide an understanding of certain embodiments of the present invention. However, it will apparent to those skilled in the art that the present invention may be practiced in other embodiments that depart from these specific details. In other instances, detailed descriptions of well known devices, gases, fasteners, and other components/systems are omitted so as to not obscure the description of the present invention with unnecessary detail.

Figure 4:
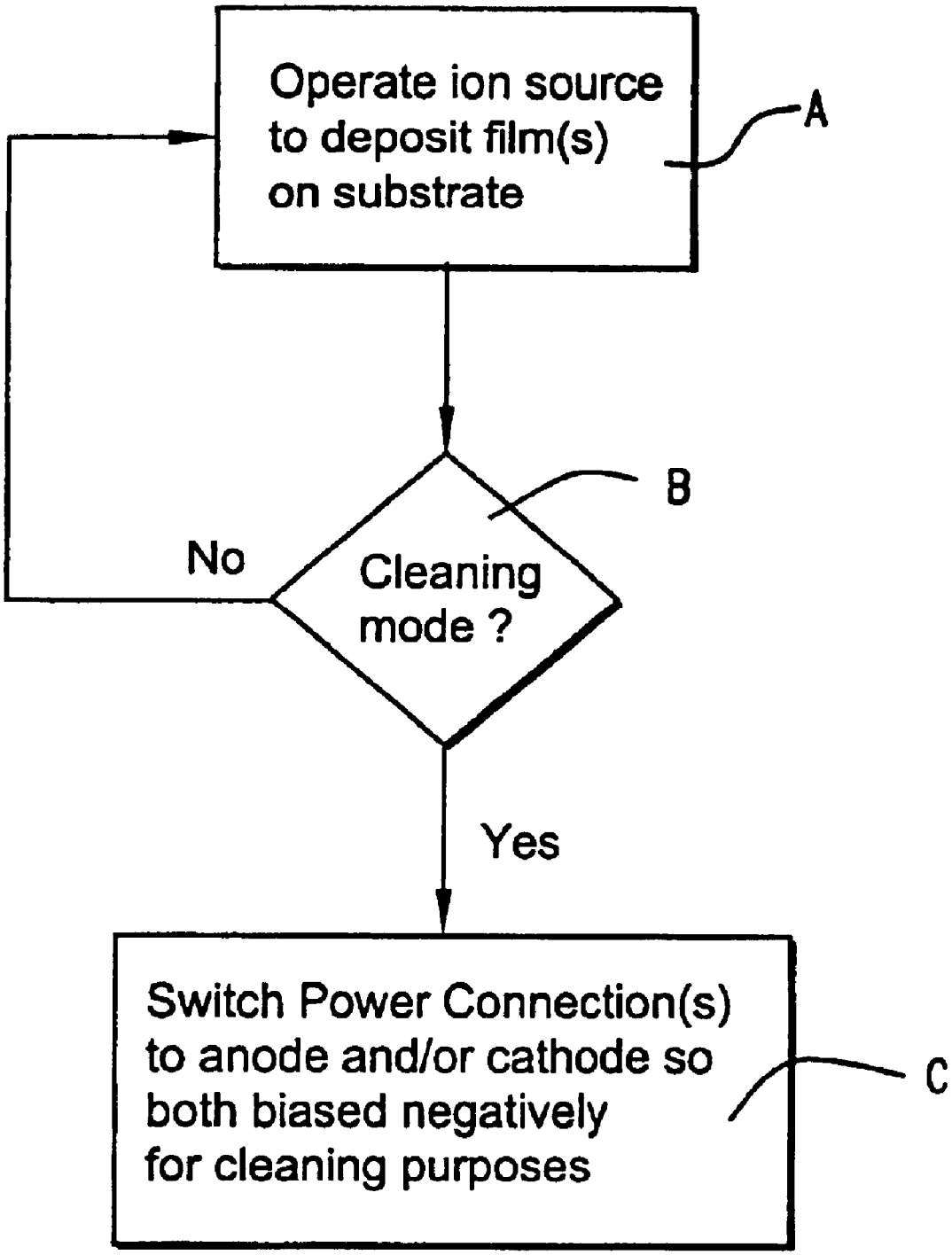
FIG. 4 is a flowchart illustrating steps taken in cleaning an ion source in certain embodiments of this invention.

FIG. 4 is a flowchart illustrating certain steps carried out in accordance with certain example embodiments of this invention. During normal operation, the ion source may be operated as described above with respect to FIGS. 1–3, or in any other suitable manner (step A). When cleaning of the ion source is desired (e.g., when it is desired to clean off insulative build-up such as carbon inclusive build-up, or any other sort of undesirable build-up from the anode and/or cathode) (step B), both the anode and cathode of the ion source are negatively biased (step C). The anode and cathode may be negatively biased during the entire cleaning operation, or during only part of the cleaning operation in different embodiments of this invention. Surprisingly, it has been found that when the anode and cathode of an ion source are both negatively biased, undesirable build-ups (e.g., carbon inclusive build-ups, or the like) on surface(s) of the anode and/or cathode are more easily and/or quickly removed during cleaning. It has been found that biasing both the anode and cathode negatively (e.g., by several hundred volts) causes the ion source to behave in a manner similar to a planar magnetron. This so-called magnetron mode of operation enables rapid, in-situ cleaning of the ion beam source periodically during operation thereof.

Figure 5:
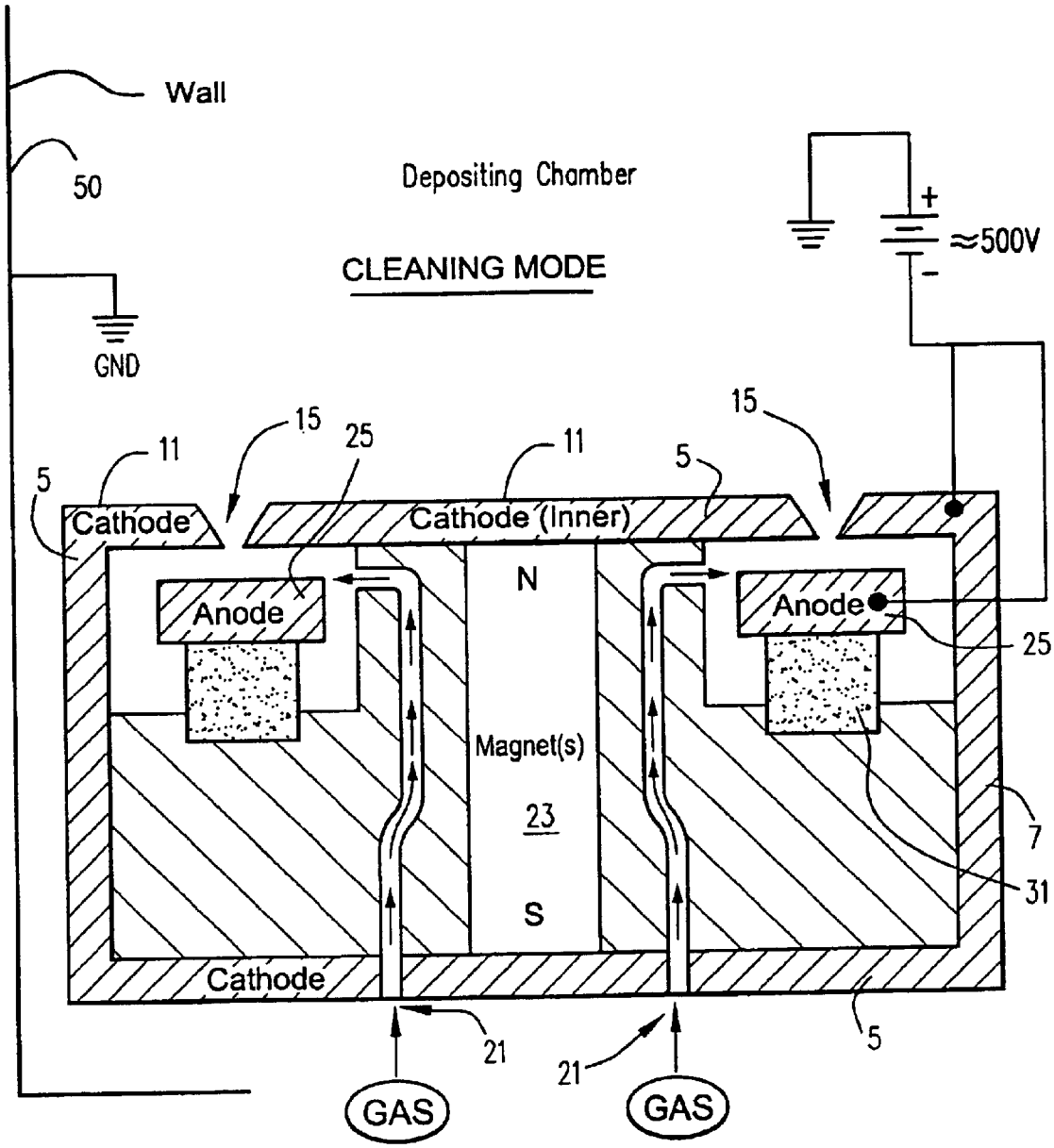
FIG. 5 is a schematic partial cross sectional view of an ion source during cleaning mode according to an embodiment of this invention.

FIG. 5 is a schematic partial cross sectional view of an ion source in cleaning mode according to an example embodiment of this invention. During normal operation (e.g., when the ion source is being used in a depositing mode to deposit a layer(s) on a substrate), the ion source of FIG. 5 is operated as described above with respect to FIGS. 1–3. Thus, during normal operation in a depositing mode, the anode 25 is biased positive by several thousand volts (e.g., from about 1,000 to 5,000 V), and cathode 5 is at, or close to, ground potential.

However, during at least part of a cleaning mode, both the anode 25 and cathode 5 of the ion source are negatively biased as shown in FIG. 5. As explained above, it has been found that when the anode 25 and cathode 5 of the ion source are both negatively biased, undesirable build-ups (e.g., carbon inclusive build-ups, or the like) on surface(s) of the anode and/or cathode are more easily and/or quickly removed during cleaning. In such instances of cleaning mode, both the anode 25 and cathode 5 may be negatively biased by from about 50 to 1,500 V, more preferably from about 100 to 1,000 V, and most preferably from about 200 to 800 V. In certain example embodiments, both the anode 25 and cathode 5 may be negatively biased with respect to ground to the same degree (e.g., both negative at 500 V). However, in alternative embodiments, the anode and cathode may be negatively biased with respect to ground to different degrees.

Wall 50 at least partially surrounds anode 25, cathode 5 and/or substrate 45 in certain embodiments of this invention. However, in other embodiments, wall 50 may be used for shielding purposes and need not surround any of these components. During cleaning mode, in certain embodiments the conductive wall 50 may be grounded (or at a potential proximate ground), thereby creating a potential between the wall 50 and the negatively biased anode and cathode. Conductive wall 50 may or may not be part of the source itself in different embodiments of this invention.

A gas such as oxygen may be run through the ion source via inlet(s) 21 (or any other suitable inlet) during cleaning mode. Alternatively, the oxygen gas may be introduced into the source via the deposition chamber thereof between the aperture 15 and the substrate support (as opposed to via inlet 21). When the gas comprising oxygen is present in the source during negative biasing of the anode 25 and cathode 5, oxygen ions generated in the plasma are accelerated or otherwise directed toward the anode 25 and/or cathode 5 in order to help remove residue (e.g., carbon inclusive build-ups) from the surface(s) thereof. Such build-ups may be removed by the simple physical ablation thereof by the ions, and/or due to chemical oxidation thereof in view of the oxygen presence. The plasma in which the ions are generated may be formed in view of the negative biasing of the anode 25 and cathode 5 relative to the grounded wall 50 in certain embodiments of this invention. This enables surfaces of the anode 25 and cathode 5 distant from the aperture 15 to be more easily and/or efficiently cleaned (compared to if the anode and cathode were biased with opposite polarities).

Figure 1:
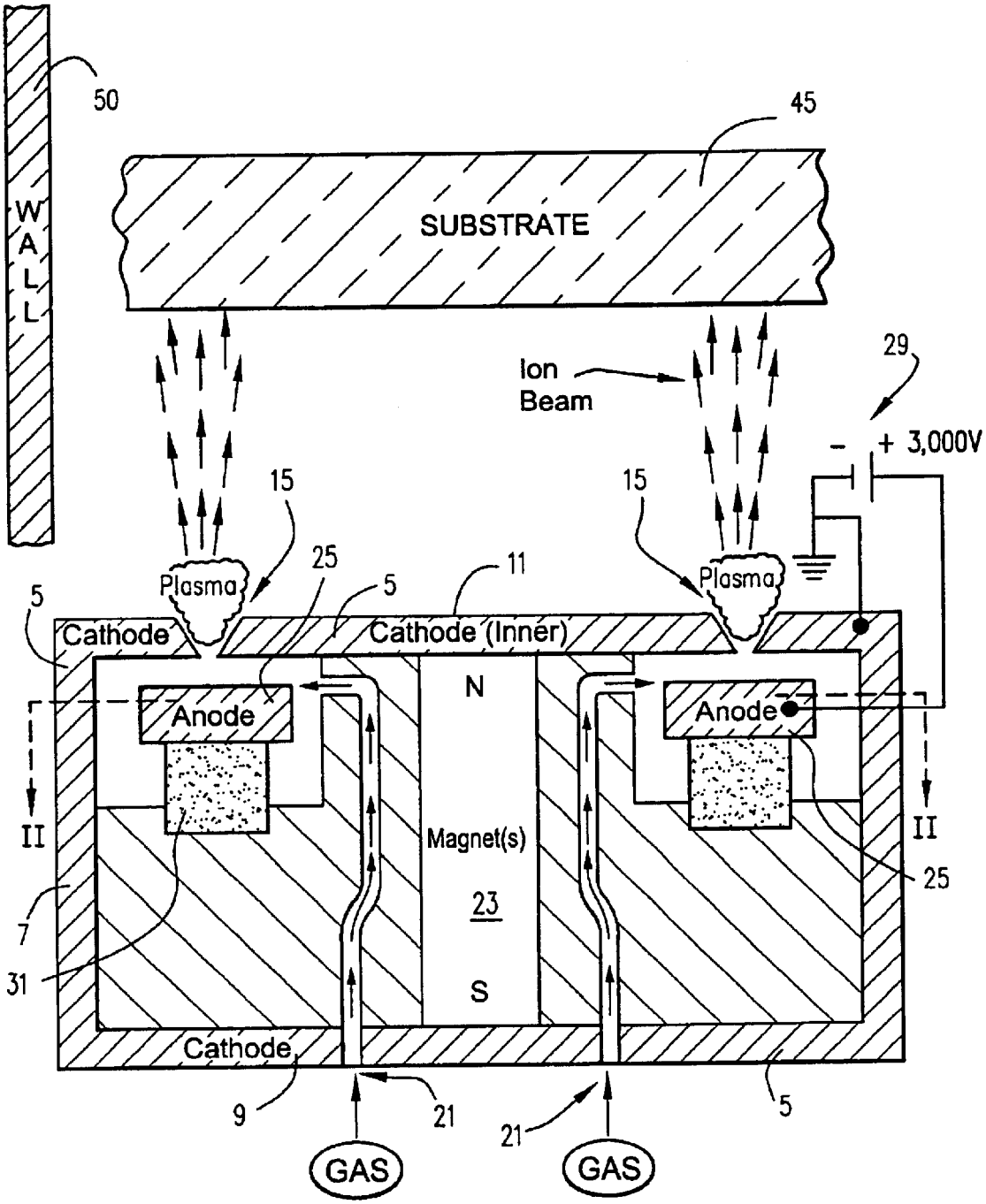
Fig. 1 (PRIOR ART)
FIG. 1 is a schematic partial cross sectional view of a conventional cold cathode closed drift ion source.

In certain example embodiments of this invention, the cleaning mode may include at least first and second different phases. In the first phase, the anode 25 may be biased positive and the cathode 5 negative as shown in FIG. 1, while gas (e.g., oxygen inclusive gas) is introduced into the source. This may result in the anode and/or cathode being efficiently cleaned proximate the aperture 15 since many ions are generated proximate thereto. In the second phase (which can either follow or precede the first phase), both the anode 25 and cathode 5 are negatively biased as shown in FIG. 5 while gas (e.g., oxygen inclusive gas) is introduced into the source so that other portions of the anode and/or cathode can be more efficiently cleaned.

While oxygen may be used as a cleaning gas in certain embodiments of this invention, the invention is not so limited. Other gas(es) may instead be used in other embodiments of this invention. Moreover, oxygen may be used in combination with other gas(es) during cleaning mode in certain example embodiments of this invention. For example, a combination of oxygen and argon gas may be introduced into the ion source during any of the aforesaid cleaning modes in certain embodiments of this invention.

Figure 6:
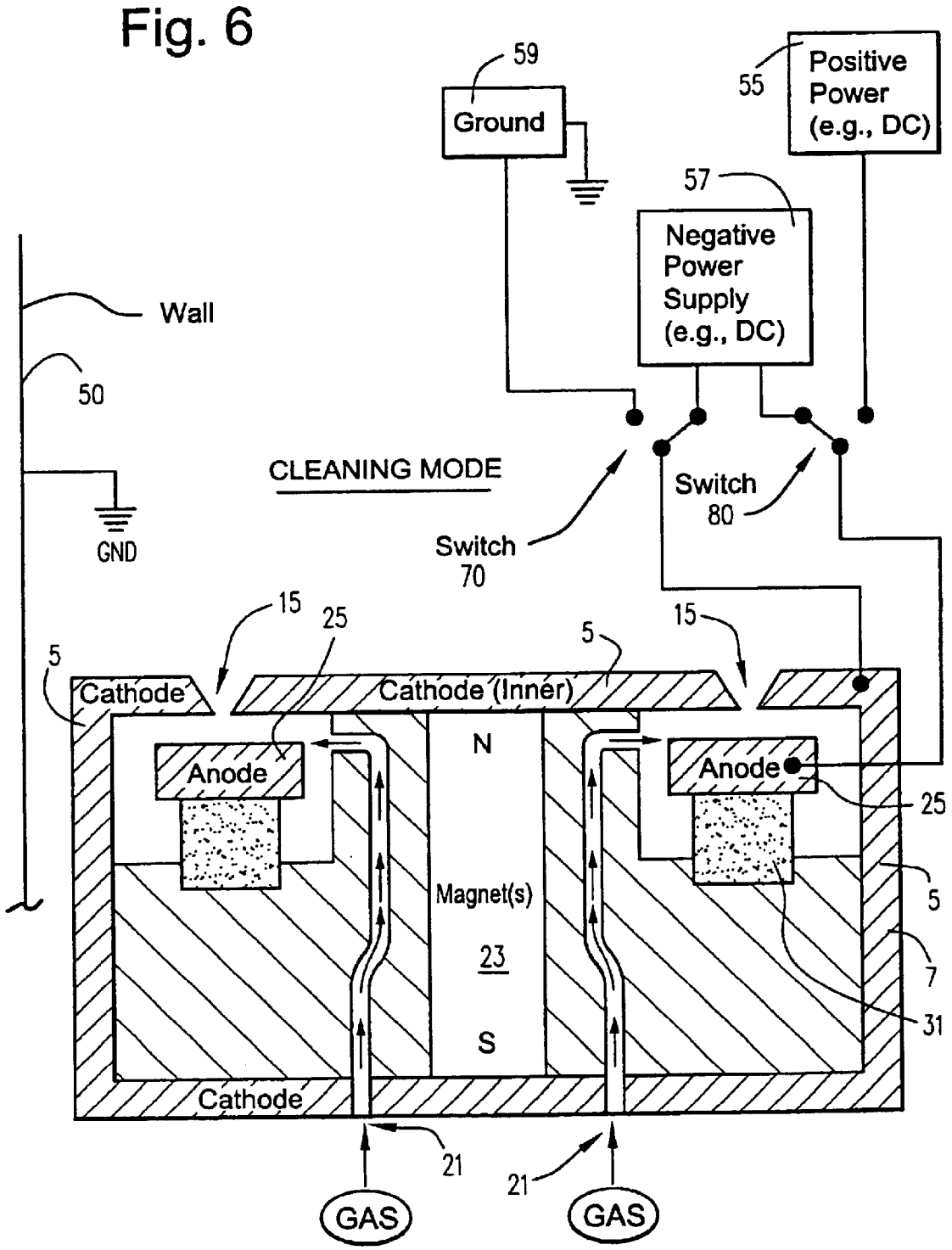
FIG. 6 is a schematic partial cross sectional view of an ion source according to an example embodiment of this invention.

FIG. 6 is similar to FIG. 5, except that it illustrates in detail example circuitry that enables the ion source to switch back and forth between, for example, cleaning and depositing modes; and/or between different phases of cleaning mode. The circuitry includes positive power supply 55, negative power supply 57 and ground (GND) 59. Switch 70 enables cathode 5 to be switched back and forth between being negatively biased with respect to ground via negative power supply 57, and ground 59. Meanwhile, switch 80 enables anode 25 to switch back and forth between being positively biased with respect to ground via positive power supply 55, and negatively biased with respect to ground via negative power supply 57. The negative power supply 57 used in negatively biasing the anode and cathode during the cleaning mode is not the same power supply that is used for high voltage applications during normal operation of the ion source in certain example embodiments of this invention. Negative power supply 57 may be a sputtering power supply (e.g., DC or AC magnetron power supply that provides more current (e.g., 15–30 amps) and a voltage of less than 1,000 V).

In a cleaning mode, gas comprising oxygen and/or argon may be used in the case of carbon build-ups. In the case of silicon-carbide build-ups, argon or some other inert gas such as Xe may be used.

Figure 7:
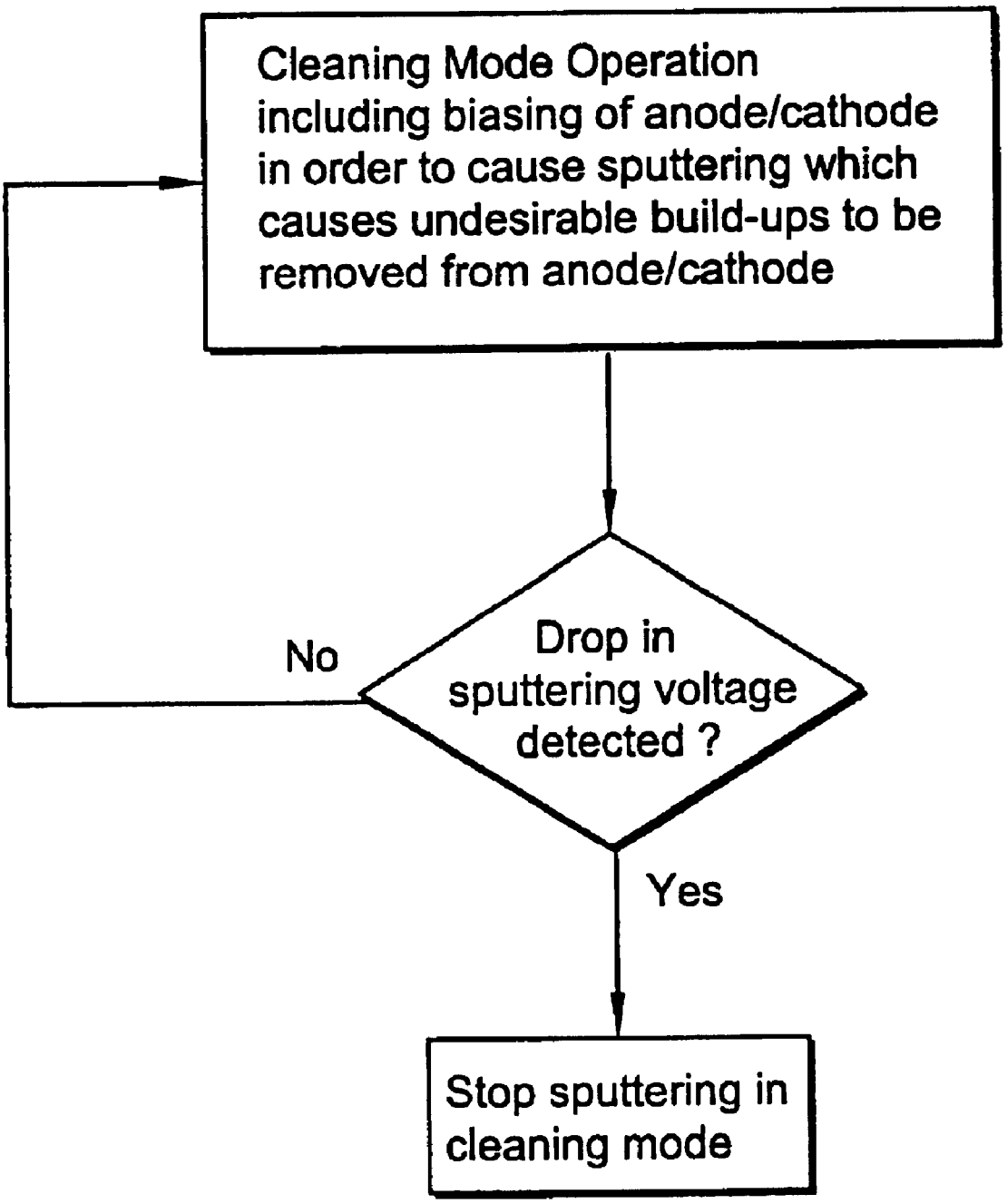
FIG. 7 is a flowchart illustrating certain steps carried out according to an embodiment of this invention, in which sputtering voltage used during cleaning is used to determine when to stop sputtering (i.e., when to stop cleaning mode) so as to prevent the electrode(s) from being substantially sputtered/etched.

Moreover, when sputtering the undesirable build-ups off of the anode/cathode (i.e., electrodes), it is desirable to stop the sputtering at an appropriate point in time so that the electrodes themselves (e.g., made of iron, steel, or the like) are not sputtered because you do not want the electric and/or magnetic gaps to change significantly. In order to achieve this point of stoppage, the sputtering voltage between the body of the source and ground may be analyzed. This sputtering voltage tends to drop once the undesirable build-ups have been removed. Thus, this drop in sputtering voltage may be used as an end-point detector for determining when to stop cleaning mode. Alternatively, an optical emissions spectroscopy tool may be used to determine a desirable cleaning mode end-point at which to stop sputtering. In this regard, FIG. 7 is a flowchart illustrating certain steps carried out according to an embodiment of this invention, in which sputtering voltage used during cleaning is used to determine when to stop sputtering (i.e., when to stop cleaning mode) so as to prevent the electrode(s) from being substantially sputtered/etched. The sputtering voltage is of course defined by the negative biasing of the electrodes during cleaning mode.

Still referring to FIG. 6, during at least some part or phase of a cleaning mode, both the anode 25 and the cathode 5 are negatively biased with respect to ground. This may be achieved for example by connecting both anode 25 and cathode 5 to the same negative power supply 57 when switches 70 and 80 are positioned as shown in FIG. 6. When it is desired to switch to a mode of normal operation or to a different phase of cleaning, switch 80 (and optionally switch 70) can be moved to the other illustrated terminal so that the anode 25 becomes positively biased with respect to the cathode 5.

In the embodiments described above and illustrated in FIGS. 4–6, the anode 25 and cathode 5 are negatively biased with respect to ground. However, in other embodiments of this invention, the anode and cathode may be negatively biased during at least part of a cleaning mode not with respect to ground, but with respect to the bias of conductive wall 50. Thus, the phrase "negatively biased" (or the like) as used herein with respect to the anode and cathode means that the anode and cathode are negatively biased with respect to ground and/or with respect to some other conductive body of or proximate the source such as wall 50.

While the figures herein illustrate the substrate being located above the anode and cathode, this invention is clearly not so limited. The apparatus may of course be inverted so that the substrate is below the anode and cathode (or on a side), in different embodiments of this invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of cleaning an ion source, the method comprising:

providing the ion source including an anode, a cathode, and a magnet, wherein at least one of the anode and the cathode includes an ion emitting aperture defined therein that is used for directing ions toward a substrate during a depositing mode of operation of the ion source; and during at least part of a cleaning mode, negatively biasing both the anode and the cathode of the ion source while at least one gas for ionization is present proximate the anode and/or cathode, so that the anode and/or cathode can be cleaned.

2. The method of claim 1, wherein during at least part of the cleaning mode both the anode and cathode are negatively biased by from about 50 to 1,500 V.

3. The method of claim 1, wherein during at least part of the cleaning mode both the anode and cathode are negatively biased by from about 100 to 1,000 V.

4. The method of claim 1, wherein during at least part of the cleaning mode both the anode and cathode are negatively biased by from about 200 to 800 V.

5. The method of claim 1, wherein during at least part of the cleaning mode both the anode and cathode are negatively biased with respect to a conductive wall which is located proximate at least one of the anode and cathode.

6. The method of claim 5, wherein the conductive wall at least partially surrounds at least one of the anode and cathode.

7. The method of claim 1, wherein during at least part of the cleaning mode both the anode and cathode are negatively biased with respect to ground, and wherein a wall proximate the anode and/or cathode is grounded.

8. The method of claim 1, wherein the gas comprises oxygen.

9. A method of switching an ion source between a depositing mode and a cleaning mode, the method comprising:

providing the ion source which includes an anode and a cathode, wherein at least one of the anode and cathode includes an ion emitting aperture defined therein;

during the depositing mode, positively biasing the anode with respect to ground and the cathode while a depositing gas is present proximate the anode and/or cathode so that ions generated are directed from the aperture toward a substrate on which a layer(s) is to be deposited; and during a cleaning mode, negatively biasing both the anode and cathode so that the anode and/or cathode can be cleaned.

10. The method of claim 9, wherein during the cleaning mode, both the anode and cathode are negatively biased to the same degree with respect to ground.

11. A method of cleaning an ion source, the method comprising:

providing the ion source which includes an anode and a cathode; and negatively biasing both the anode and cathode during at least part of a cleaning mode.

12. The method of claim 11, wherein the anode is positively biased with respect to the cathode during a depositing mode of source operation, and wherein the anode and cathode are both negatively biased to the same degree during the cleaning mode.

13. The method of claim 11, further comprising introducing a gas comprising oxygen into the ion source during the cleaning mode.

14. An ion source comprising:

an anode;

a cathode;

wherein at least one of the anode and cathode comprises an ion emitting aperture defined therein;

a circuit for negatively biasing the anode and cathode during at least part of a cleaning mode so that the anode and/or cathode can be cleaned during the cleaning mode.

15. The ion source of claim 14, further comprising means for positively biasing the anode with respect to the cathode during a depositing mode of ion source operation when the source is used to depositing a layer(s) on a substrate, and wherein the circuit for negatively biasing includes means for negatively biasing the anode and cathode to the same degree with respect to ground during at least part of the cleaning mode.

16. The ion source of claim 14, wherein the anode surrounds at least part of a magnet which is located along a central axis of the anode, and wherein the ion emitting aperture is defined in the cathode.

17. A method of cleaning an ion source, the method comprising:

providing the ion source which includes an anode and a cathode, wherein at least one of the anode and cathode includes an ion emitting aperture defined therein;

during a cleaning mode, biasing the anode and cathode so that the anode and/or cathode can be cleaned by sputtering undesirable build-ups off of respective surface(s) of the anode and/or cathode; and determining when to stop the sputtering in the cleaning mode based upon at least a change in sputtering voltage present during the cleaning mode due to the biasing.

18. The method of claim 17, wherein the sputtering in the cleaning mode is stopped when the sputtering voltage drops which is an indication that the buildups have been removed for the surface(s) of the anode and/or cathode.

* * * * *